United States Patent [19]

Flippin

[11] Patent Number: 4,541,193

[45] Date of Patent: Sep. 17, 1985

[54] REVOLVER CYLINDER AND EXTRACTOR ASSEMBLY

[76] Inventor: George F. Flippin, P.O. Box 15741, Houston, Tex. 77020

[21] Appl. No.: 571,934

[22] Filed: Jan. 19, 1984

[51] Int. Cl.[4] ..... F41C 1/00; F41C 15/00

[52] U.S. Cl. ..... 42/68

[58] Field of Search ..... 42/59, 68

[56] References Cited

U.S. PATENT DOCUMENTS

| | | | |
|---|---|---|---|
| 923,068 | 5/1909 | Neal | 42/89 |
| 1,181,417 | 5/1916 | Wesson | 42/68 |
| 3,755,950 | 9/1973 | Gunn | 42/68 |
| 3,982,346 | 9/1976 | Pilorget | 42/68 |
| 4,015,356 | 4/1977 | Maillard | 42/68 |
| 4,127,955 | 12/1978 | Curran | 42/68 |

*Primary Examiner*—Deborah L. Kyle

*Assistant Examiner*—Ted L. Parr

*Attorney, Agent, or Firm*—Bill B. Berryhill

[57] ABSTRACT

An improved cylinder and extractor assembly for use in a revolver comprising a cylinder having a central longitudinal chamber and a plurality of longitudinal cartridge chambers at uniformly spaced intervals thereabout and including radial slots at the rear of the cylinder providing communication between the central chamber and each of the cartridge chambers. An extractor assembly, centrally disposed in the central chamber, includes an extractor member having circumferentially spaced radial projections each one of which may be disposed in one of the radial slots at the rear of the cylinder for engagement with the groove of a cartridge. The extractor member is axially movable from a first position, within the central chamber to a second position substantially rearwardly of the central chamber, to force cartridges from the cartridge chambers.

20 Claims, 6 Drawing Figures

REVOLVER CYLINDER AND EXTRACTOR ASSEMBLY

BACKGROUND OF THE INVENTION

1. Field of the Invention

The present invention pertains to revolver type firearms. More specifically, the present invention pertains to revolver cylinders and extractor assemblies for extracting cartridges from the cylinder of a revolver.

2. Description of the Prior Art

Most revolvers are designed for firing ammunition with rimmed cartridges of a specific diameter and length. Rimless cartridges, primarily for use in automatic pistols, can also be adapted for use in revolvers by using special clips. However, certain disadvantages are associated with these clips. Revolver extractor assemblies for rimless cartridges have also been developed. (See U.S. Pat. Nos. 3,982,346 and 4,127,955.) However, there are some problems associated with these designs.

As mentioned, most revolvers are designed for a specific type of cartridge and may not be used to fire other ammunition, even though the caliber is essentially the same. Thus, if the user cannot obtain the specific type ammunition, his revolver may be useless. Conversion assemblies have been designed for converting a revolver for use of sub-caliber ammunition. (See U.S. Pat. No. 2,976,638.) However, such conversion requires the availability of a conversion kit and requires a certain amount of time to make the conversion. So far as is known by the applicant, no one has developed a revolver capable of using a number of types of ammunition both rimmed and rimless, without having to adapt the ammunition or convert the revolver.

SUMMARY OF THE INVENTION

The present invention provides a revolver which is capable of firing both rimmed and rimless cartridge ammunition of differing diameters and lengths. For example, a revolver as proposed in the present invention may be capable of firing, without alteration, the following ammunition: 38 standard, 38 automatic, 357 magnum, 9 mm., 38 super, 38 Smith & Wesson, etc. To accomplish this, the revolver is provided with an improved cylinder and extractor assembly.

The improved cylinder and extractor assembly of the present invention includes a cylinder, carried by the frame of a revolver, having a central longitudinal chamber and a plurality of longitudinal cartridge chambers at uniformly spaced intervals about the central chamber and including radial slots at the rear of the cylinder providing communication between the central chamber and each of the cartridge chambers. The cylinder is rotatable about a central axis to sequentially align the cartridge chambers with the barrel of the revolver. The cylinder is also pivotally mounted so as to allow the cylinder to pivot away from the frame so that each of the cartridge chambers is unobstructed by the frame.

An extractor assembly is centrally disposed in the central chamber of the cylinder and includes an extractor member having circumferentially spaced radial projections thereon, each one of which may be disposed in one of the radial slots in the rear of the cylinder for engagement of the rim or groove of a cartridge placed in a respective one of the cartridge chambers, properly spacing the cartridge therein. The extractor member is axially movable, when the cylinder is pivoted away from the frame, from a first position, within the central chamber, to a second position substantially rearwardly of the central chamber, during which any cartridges carried by the cylinder are forced out of the cartridge chambers by the radial projections.

Thus, the improved cylinder and extractor assembly of the present invention allows the firing of both rimmed and rimless cartridge ammunition of varying diameters and lengths without special devices or conversion of parts. The revolver becomes almost universal within a certain range. Thus, ammunition can be found for the revolver in almost all parts of the world. Furthermore, cheaper ammunition can be used for target practice and the like conserving more expensive and specific type of ammunition for specific use.

The improved cylinder and extractor assembly of the present invention results in a revolver of somewhat universal use which is relatively simple and easy to manufacture. Thus, a revolver may be easily and inexpensively converted to one of much more universal use and economic use. Other objects and advantages of the invention will be apparent from reading the description which follows in conjunction with the accompanying drawings.

DESCRIPTION OF THE PREFERRED EMBODIMENT

Figure 1:
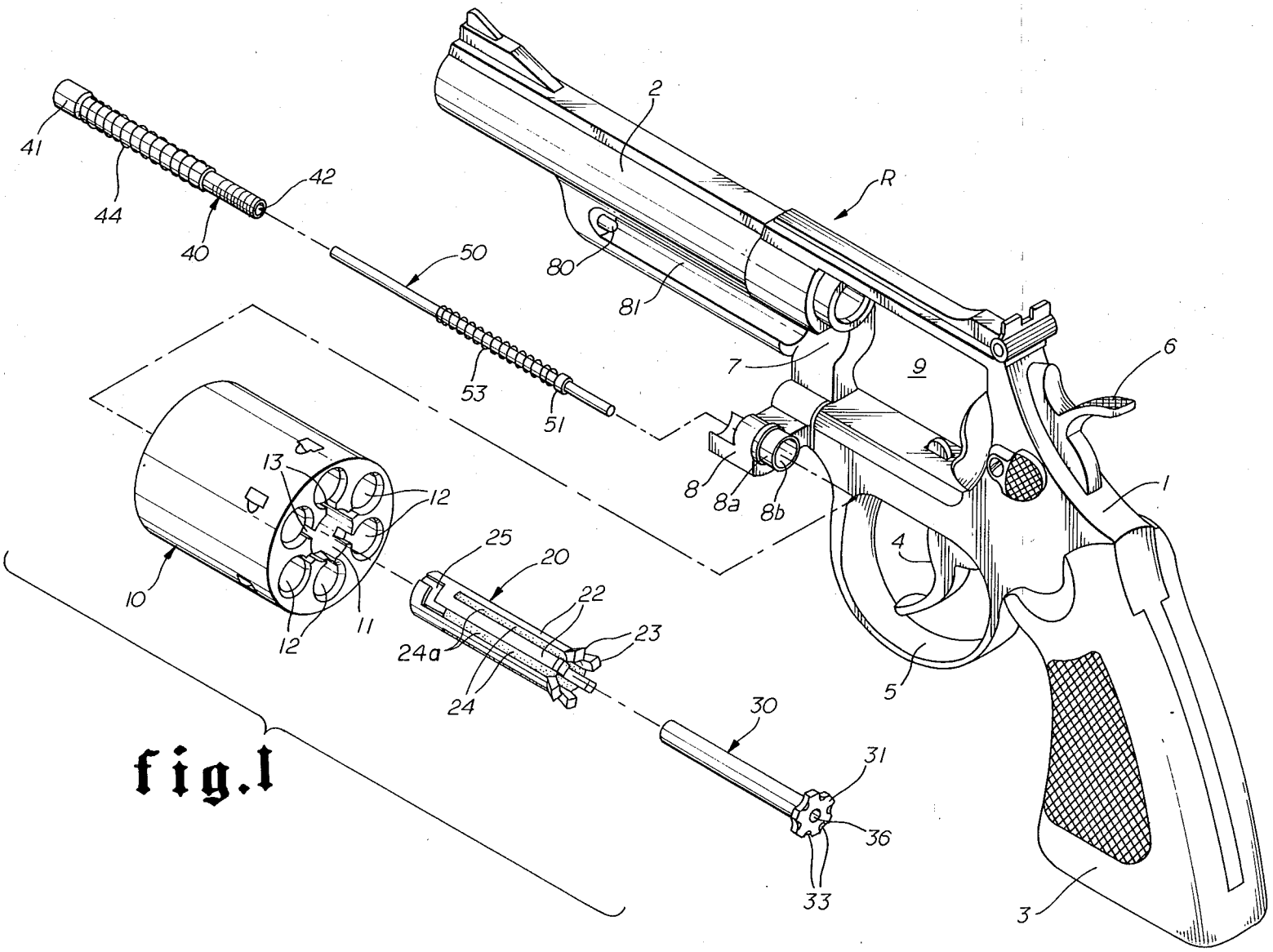
FIG. 1 is an exploded perspective view of a revolver utilizing an improved cylinder and extractor assembly, according to a preferred embodiment of the invention.

Referring first to FIG. 1, there is shown a revolver R having a frame 1, barrel 2, grip 3, and other standard components such as trigger 4, trigger guard 5, hammer 6, etc. Attached to the frame 1 for pivoting from a recess 7 to a laterally extended position (as shown) is a crane member 8. The crane member 8, which includes a journal portion 8*a* and central hole, supports an improved cylinder and extractor assembly which will be more fully described hereafter. Normally, the cylinder would be disposed in a space 9 provided therefor on the frame 1. However, the crane 8 allows the cylinder to be pivoted away from the frame 1.

Figure 4:
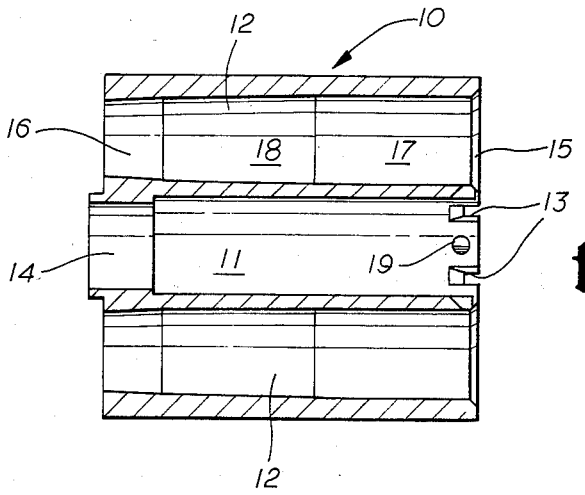
FIG. 4 is a longitudinal view, in section, of the improved cylinder shown in FIGS. 1, 2, and 3, with all other portions of the revolver removed therefrom.
Figure 5:
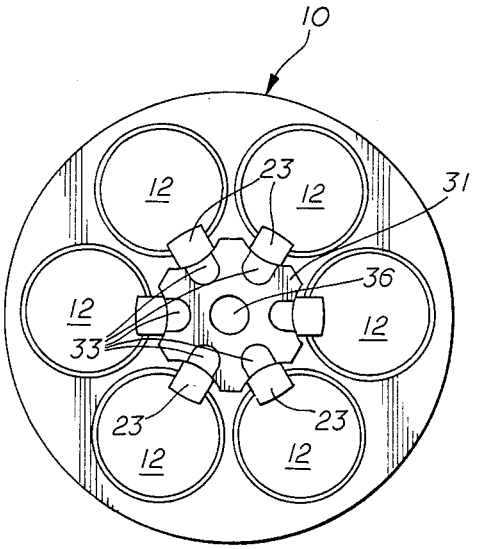
FIG. 5 is a rear view of the cylinder of FIG. 4 showing the placement of portions of the extractor assembly and ratchet mechanism relative to cartridge chambers thereabout.

The cylinder and extractor assembly includes a cylinder 10 which, as best shown in FIG. 4, has a central longitudinal chamber 11, the forward end of which is reduced in diameter to provide a bearing area 14 which rests on the journal portion 8*a* of the crane member 8 (see FIG. 1). The central chamber 11 is provided, near the rear thereof, with a pin 19 which projects radially thereinto to serve as a guide pin for the extractor assembly described hereafter. A plurality of longitudinal cartridge chambers 12 is provided at uniformly spaced intervals about the central chamber 11. Radial slots 13 are provided at the rear of the cylinder 10 providing communication between the central chamber 11 and each of the cartridge chambers 12. It will also be noted that each of the cartridge chambers 12 has a loading port 15 and an exit port 16 between which the cartridge chamber 12 is counterbored to provide at least two axially spaced bore areas 17 and 18 of slightly different diameter to accommodate cartridges of slightly different diameters and different lengths. The loading port 15 may be tapered inwardly toward the bore area 17, and exit port 16 may be tapered inwardly from the bore area 18.

Figure 6:
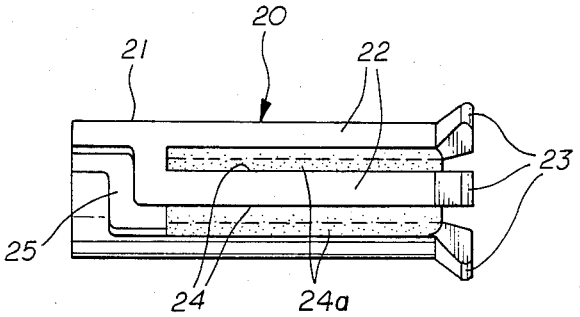
FIG. 6 is a longitudinal view of an extractor member forming a portion of the extractor assembly of the present invention.

The extractor assembly includes an extractor member 20, best shown in FIGS. 1 and 6, which has a cylindrical base portion 21 from which extends a plurality of circumferentially spaced cantilevered extractor fingers 22 at the distal ends of which are provided radial projections 23. Longitudinal spaces 24 exist between each of the extractor fingers 22. A Z-slot 25 is cut in the exterior of the base portion 21 opening into one of the spaces 24.

Centrally disposed within the extractor member 20 is a tubular ratchet member 30 at the rear end of which is a star ratchet 31 having recesses 33 engageable by a ratchet mechanism (not shown) carried by the frame 1 to effect rotation of the cylinder 10 about its central axis for sequential alignment of the cartridge chambers 12 with the barrel 2 of the revolver R when the cylinder 10 is disposed in the space 9 provided therefor. The ratchet member 30 is inserted through a central hole in the base portion 21 of the extractor member 20 and fixed thereto by a pin 35. It will also be noted that the rearward end of the ratchet member 30 is provided with a central aperture 36 which communicates with a larger diameter bore 37 thereof. Thus, an annular shoulder 38 is provided internally of the ratchet member 30. The forward end of the bore 37 is threaded to threadedly engage an extractor shaft 40 which passes through the central hole **8*b* of the crane member 8**.

Figure 2:
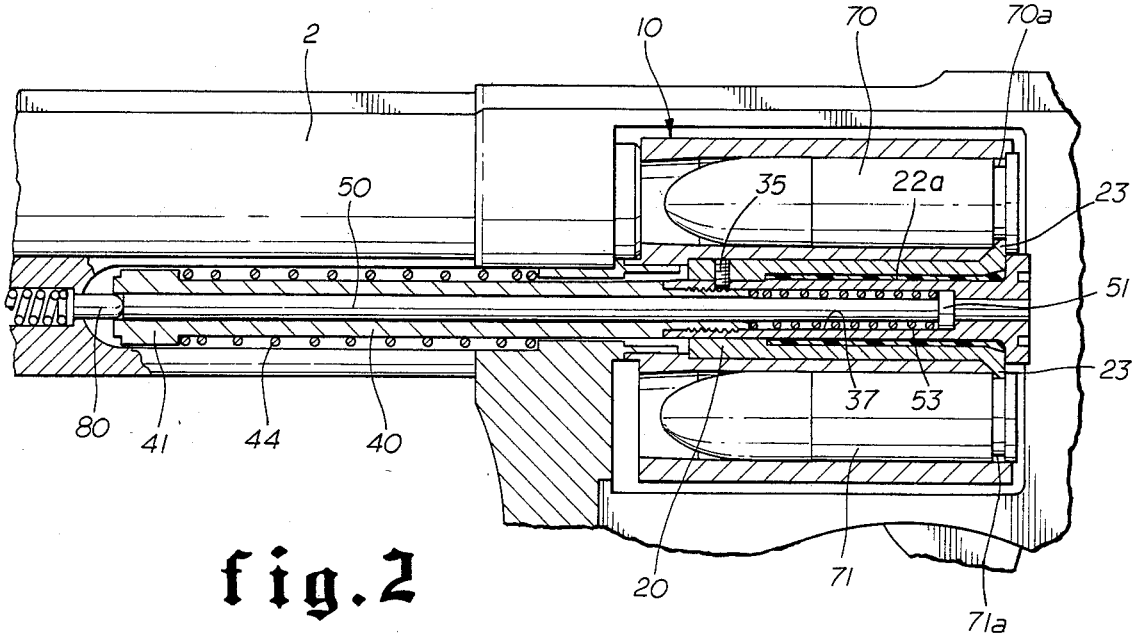
FIG. 2 is a partial side elevation view, partially in cross-section, of a portion of the revolver of FIG. 1, showing the cylinder and extractor assembly thereof in a loaded position ready for firing.

The threaded shaft 40 is provided at its forward end with an enlarged diameter knurled portion 41 and has a central aperture 42 passing through the entire length thereof. It will be noted that a helical spring 44 is provided around the extractor shaft 40 resting against the knurled head portion 41 and biasing the extractor shaft 40, the extractor 20 and the ratchet member 30 toward a forward or first position, as illustrated in FIG. 2.

Disposed in the central aperture 42 and in the central bore 37 of the ratchet member 30 is a slender cylindrical stem 50 near the rear end of which is a radial flange 51 which is engageable with the annular shoulder 38 of the ratchet member 30. When the flange portion 51 engages the radial shoulder 38, a portion of the stem 50 projects slightly rearwardly of the star-shaped portion 31 of the ratchet member 30. The stem 50 is biased toward this position by a spring member 53 which surrounds the stem within the cylindrical hole 37. However, when the cylinder 10 is pivoted to the firing position within the frame 1, the stem 50 is forced rearwardly until it engages a hole (not shown) in the frame 1 at the rear of the cylinder 10 where it then springs back into place providing support for rotation of the cylinder 10.

To assemble the cylinder and extractor assembly, the cylinder 10 is first placed on the crane member 8 by surrounding the journal portion **8*a* thereof with the cylindrical portion 14 of the central chamber 11. Then the extractor member 20 and the ratchet member 30 attached thereto are inserted into the central chamber 11. To do this, the open end of the Z-slot 25 at the forwardmost location on the extractor member 20 is engaged with the radial pin 19 which projects inwardly from the walls of the central chamber 11. After slight insertion of the extractor member 20, it is rotated so that the guide pin 19 follows the Z-slot to the portion thereof in linear communication with the space 24 between the extractor fingers 22**.

Next, the extractor shaft 40 is inserted through the hole **8*b* of the crane member 8 until the threaded end 42 thereof engages corresponding threads in the end of ratchet member 30. The ratchet shaft 40 is then rotated until the threaded connection is secure. Once this connection is secure and the extractor shaft 40 released, spring 44 biases the extractor member 20 and ratchet member 30 to the first position shown in FIG. 2. In this position, the radial projections 23 at the ends of the extractor fingers 22 engage the cylinder slots 13 so that the radial projections 23 project into the cartridge chambers 12 near the loading ports 15**.

To load shells into the cartridge chambers 12, the cylinder 10 is pivoted away from the frame 1 of the revolver or until the cartridge chambers 12 are unobstructed by the frame 1. The shells are placed in the cartridge chambers 12 by inserting through the loading ports 15. As this is done, the cantilevered extractor fingers 22 are forced inwardly allowing the shells to pass into the cartridge chambers 12 until the grooves **70*a* and 71*a* of cartridges 70 and 71 are engaged by the projections 23. As noted, the cartridges 70 shown in FIG. 2 are rimmed cartridges. The projections 23 will also engage the grooves 71*a* provided in rimless cartridges 71. The projections 23 also effectively determine the head spacing of the cartridges 70. An annular space between the extractor fingers 22 and the ratchet member 30 permits the ends of the extractor fingers to be forced inwardly as described. In preferred embodiments, this annular space and the spaces 24 between the extractor fingers may be filled with a resilient material (22*a* and 24*a*) to cushion various shock and vibration forces thereon. If this is done, the space 24 communicating with the Z-slot 25** should not be filled.

After loading, of course, the cylinder 10 is pivoted back into the space 9 provided in the frame 1 of the revolver R. It is properly supported for firing by the rear end of the guide stem 50 and by a spring loaded pin 80 provided at the terminus of the longitudinal recess 81 provided underneath the barrel 2 for receiving the extractor shaft 40.

Figure 3:
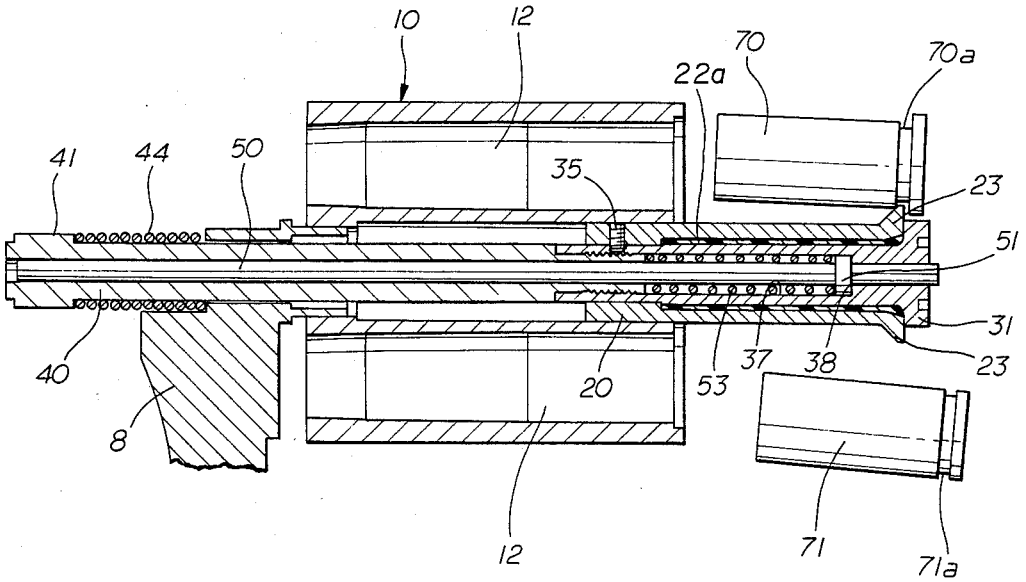
FIG. 3 is a sectional view of the improved cylinder and extractor assembly shown in FIG. 2 in which the cylinder is pivoted away from the revolver and the extractor assembly is in a second or extracted position.

After firing, the cylinder 10 may be pivoted away from the frame 1 so that the extractor shaft 40 may be gripped by the gnurled head 41 and forced to the rear compressing spring 44 and axially moving the extractor assembly, including the extractor member 20, from the first position of FIG. 2 to a second position substantially rearwardly of the central chamber 11 as shown in FIG. 3. As this is done, the spent or empty cartridges 70 and 71 are forced out of the cartridge chambers 12 by the extractor fingers 22 for removal and reloading.

Thus, the improved cylinder and extractor assembly of the present invention allows the firing of both rimmed and rimless cartridge ammunition of varying diameter and lengths without special devices or conversion of parts. For example, a cylinder and extractor assembly designed as described herein can be utilized in a revolver for firing the following ammunition: 38 standard, 38 automatic, 357 magnum, 9 mm., 38 super, 38 Smith & Wesson. The result is a revolver of somewhat universal use.

While a single embodiment of the invention is described herein, many variations may be made without departing from the spirit of the invention. Accordingly, it is intended that the scope of the invention be limited only by the claims which follow.

I claim:

1. An improved cylinder and extractor assembly for use in a revolver having a frame and barrel to permit firing of both rimmed and rimless cartridge ammunition of varying lengths, said assembly comprising:

a cylinder carried by said frame of said revolver for rotation about a central axis thereof and having a plurality of longitudinal cartridge chambers therein at uniformly spaced intervals about the central axis, said cylinder being rotatable about said central axis to sequentially align said cartridge chambers with said barrel of said revolver, said cylinder being mounted on pivot means allowing said cylinder to pivot away from said frame so that each of said chambers is unobstructed by said frame; and an extractor assembly centrally disposed in a central chamber of said cylinder including an extractor member having a base portion rearwardly from which extends a plurality of circumferentially spaced cantilevered extractor fingers at the distal ends of which are provided radial projections for engagement with the rim or groove of a cartridge to properly space said cartridge in a respective one of said cartridge chambers, said extractor member being axially movable, when said cylinder is pivoted away from said frame, from a first position, within said central chamber, to a second position, substantially rearwardly of said central chamber, during which any cartridges carried by said cylinder are forced out of said cartridge chambers by said extractor fingers.

2. An improved cylinder and extractor assembly as set forth in claim 1 including radial slots at the rear of said cylinder providing communication between said central chamber and each of said cartridge chambers and for receiving a respective one of said radial projections, when said extractor member is in said first position, for said engagement with the rim or groove of a cartridge placed in a respective one of said cartridge chambers.

3. An improved cylinder and extractor assembly as set forth in claim 2 in which the distal end of said cantilevered extractor fingers may be forced inwardly by radial forces applied to said radial projections upon insertion of cartridges into said cartridge chambers, remaining in outwardly biased engagement with the rim or groove of said cartridges upon complete insertion into said cartridge chambers.

4. An improved cylinder and extractor assembly as set forth in claim 3 in which the interior of said extractor member immediately inwardly of said extractor fingers is provided with a resilient material to cushion forces applied to said extractor fingers.

5. An improved cylinder and extractor assembly as set forth in claim 1 in which longitudinal spaces existing between said extractor fingers are at least partially filled with a resilient material.

6. An improved cylinder and extractor assembly as set forth in claim 1 in which said extractor member is attached to a shaft which projects forwardly of said cylinder, said shaft being engageable by the user of said revolver, when said cylinder is pivoted away from said frame, to effect said axial movement of said extractor member from said first position to said second position.

7. An improved cylinder and extractor assembly as set forth in claim 6 including means biasing said shaft and extractor member toward said first position so that upon disengagement of said shaft by said revolver user said extractor member is automatically returned to said first position.

8. An improved cylinder and extractor assembly as set forth in claim 1 in which each of said cartridge chambers has a loading port and an exit port between which said cartridge chamber is counterbored to provide at least two axially spaced bore areas of slightly different diameter to accommodate cartridges of slightly different diameters and different lengths.

9. An improved cylinder and extractor assembly as set forth in claim 8 in which said loading port tapers inwardly toward the one of said bore areas immediately forward thereof and said exit port tapers inwardly from the one of said bore areas immediately rearward thereof.

10. An improved cylinder and extractor assembly for use in a revolver having a frame and barrel to permit firing of both rimmed and rimless cartridge ammunition, said assembly comprising:

a cylinder carried by said frame of said revolver having a central longitudinal chamber and a plurality of longitudinal cartridge chambers at uniformly spaced intervals about said central chamber and including radial slots at the rear of said cylinder providing communication between said central chamber and each of said cartridge chambers, said cylinder being rotatable about a central axis to sequentially align said cartridge chambers with the barrel of said revolver, said cylinder being mounted on pivot means allowing said cylinder to pivot away from said frame so that each of said cartridge chambers is unobstructed by said frame; and an extractor assembly centrally disposed in said central chamber of said cylinder including an extractor member having circumferentially spaced radial projections each one of which may be disposed in one of said radial slots at the rear of said cylinder for engagement of the rim or groove of a cartridge placed in a respective one of said cartridge chambers and properly spacing said cartridge therein, said extractor member being axially movable, when said cylinder is pivoted away from said frame, from a first position within said central chamber, to a second position substantially rearwardly of said central chamber, during which any cartridges carried by said cylinder are forced out of said cartridge chambers by said radial projections.

11. An improved cylinder and extractor assembly as set forth in claim 10 in which said extractor member is attached to a shaft which projects forwardly of said cylinder, said shaft being engageable by the user of said revolver, when said cylinder is pivoted away from said frame, to effect said axial movement of said extractor member from said first position to said second position.

12. An improved cylinder and extractor assembly as set forth in claim 11 including means biasing said shaft and extractor member toward said first position so that upon disengagement of said shaft by said revolver user, said extractor member is automatically returned to said first position.

13. An improved cylinder and extractor assembly as set forth in claim 10 in which each of said cartridges has a loading port and an exit port between which said cartridge chamber is counterbored to provide at least two axially spaced bore areas of slightly different diameter to accommodate cartridges of slightly different diameter and different lengths.

14. An improved cylinder and extractor assembly as set forth in claim 10 in which said extractor member comprises a base portion rearwardly from which extends a plurality of circumferentially cantilevered extractor fingers at the distal ends of which are said radial projections.

15. An improved cylinder and extractor assembly as set forth in claim 14 in which said base portion of said extractor member is provided with a Z-shaped slot which communicates with one of the longitudinal spaces between a pair of said extractor fingers, said Z-shaped slot being engageable with a guide pin radially disposed in said central chamber, upon assembly, so that said guide pin is eventually disposed for longitudinal movement, relative to said extractor member, within said one of said longitudinal spaces, permitting said axial movement of said extractor member but preventing rotation thereof relative to said central chamber.

16. An improved cylinder and extractor assembly as set forth in claim 14 in which most of the longitudinal spaces between said extractor fingers are at least partially filled with a resilient material.

17. An improved cylinder and extractor assembly as set forth in claim 14 including a ratchet member centrally disposed with respect to said extractor member engageable with a ratchet mechanism carried by said frame to effect said rotation of said cylinder about said central axis for said sequential alignment of said cartridge chambers with the barrel of said revolver.

18. An improved cylinder and extractor assembly as set forth in claim 17 in which said ratchet member is fixed to said extractor member leaving an annular space between the exterior of said ratchet member and the interior surfaces of said extractor fingers.

19. An improved cylinder and extractor assembly as set forth in claim 18 in which said annular space is at least partially filled with a resilient material to cushion forces applied to said extractor fingers.

20. An improved cylinder and extractor assembly as set forth in claim 14 in which the interior of said extractor member immediately inwardly of said extractor fingers is provided with a resilient material to cushion forces applied to said extractor fingers.

* * * * *